United States Patent [19]

Gauld et al.

[11] 4,155,840

[45] May 22, 1979

[54] FOUR GROUP SIZE VIBRATORY SCREENING APPARATUS

[75] Inventors: W. Thomas Gauld, Mobile, Ala.; Arthur V. Jepsen, Franklin, N.C.

[73] Assignee: Gauld Equipment Sales Company, Theodore, Ala.

[21] Appl. No.: 874,860

[22] Filed: Feb. 2, 1978

[51] Int. Cl.[2] ..... B07B 1/06

[52] U.S. Cl. ..... 209/245; 209/317; 209/275

[58] Field of Search ..... 209/150, 254, 315, 317, 209/355, 283, 278, 497, 498, 243, 244, 245, 247, 316, 332, 274–277, 370–373

[56] References Cited

U.S. PATENT DOCUMENTS

| | | | |
|---|---|---|---|
| 726,172 | 4/1903 | Korâb | 209/315 |
| 1,501,047 | 7/1924 | Hall | 209/329 |
| 2,384,181 | 9/1945 | La Fave | 209/245 |
| 3,108,949 | 10/1963 | Fehlmann | 209/150 |
| 3,416,660 | 12/1968 | Larsson | 209/317 |
| 3,504,793 | 4/1970 | Eaton et al. | 209/317 |
| 3,819,050 | 6/1974 | Lower | 209/254 |

*Primary Examiner*—Robert Halper

*Assistant Examiner*—Jon Hokanson

*Attorney, Agent, or Firm*—John R. Walker, III

[57] ABSTRACT

An apparatus for sorting wood chips or other particulate material into groups according to size. The apparatus includes a housing having an opened top, a first screen attached to the housing substantially covering the opened top thereof, a second screen attached to the housing beneath the first screen, and a hopper fixedly attached to the housing for holding a quantity of wood chips and for depositing wood chips onto substantially the center of the first screen. The first and second screens slope downwardly from the centers thereof so that any wood chips of a size too large to pass therethrough will pass, aided by the force of gravity, to the periphery thereof. The openings in the second screen are smaller than the openings in the first screen thereby causing the wood chips deposited on the first screen from the hopper to be sorted into the three groups: Those too large to pass through the first screen; those which passed through the first screen but not the second screen; and those which passed through both the first and second screen. The apparatus may include a third screen for sorting wood chips into four groups.

1 Claim, 2 Drawing Figures

FOUR GROUP SIZE VIBRATORY SCREENING APPARATUS

BACKGROUND OF THE INVENTION

1. Field of the Invention:

This invention relates to sorting or screening machinery of the type used to sort particulate material such as wood chips into groups of different size material.

2. Description of the Prior Art:

Heretofore, various sorting or screening apparatuses have been developed. See, for example, Hall, U.S. Pat. No. 1,501,047; Simpson, U.S. Pat. No. 2,946,440; Walker, U.S. Pat. No. 3,123,551; Larsson, U.S. Pat. No. 3,416,660; Ingram, U.S. Pat. No. 3,456,794; Miller, U.S. Pat. No. 3,616,906; Lower, U.S. Pat. No. 3,819,050; and Lower, U.S. Pat. No. 3,928,189. None of these patents, taken as a whole, disclose or suggest the present invention.

SUMMARY OF THE INVENTION

The present invention is directed towards providing a more economical and efficient apparatus for sorting a mix of different particulate material into groups according to size. Larsson, U.S. Pat. No. 3,416,660 and Lower, U.S. Pat. No. 3,819,050 disclose the type sorting apparatus that is now typically used to sort particulate material such as wood chips. These apparatuses include a sorter housing and a separate material hopper and sort the particulate material by way of an inward flow across screens of various sizes. The concept of the present invention is to fixedly attach the sorter housing and the feed hopper thereby allowing, among other things, the same drive unit that causes the sorter housing to vibrate to drive the feed mechanism of the feed hopper thus resulting in a more economical sorter; and to sort the particulate material by way of an outward flow across the screen which results in a more efficient sorter. The importance of the outward flow sorting of the present invention is most apparent when the mix of particulate material to be sorted is fed onto a screen of a size which will not allow the majority of the particulate material to pass therethrough and when the sorter housing is substantially concentric about a central point (i.e., when the sorter housing and the screens are circular or polygonal or the like). In such a case, the outward flow sorting of the present invention will result in a gradual increase in sorting screen area thereby providing maximum small particle removal efficiency. On the other hand, the inward flow sorting of the prior art will result in a gradual decrease in sorting screen area while the amount of material remaining on the screen stays substantially the same thereby resulting in minimum small particle removal efficiency.

The sorting apparatus of the present invention includes, in general, a housing means having an opened top; a hopper means for holding a quantity of particulate material, the hopper means having an outlet port for allowing particulate material to exit therethrough, the hopper means being fixedly attached to the housing means with the outlet port of the hopper means positioned substantially over the center of the opened top of the housing means; a first screen means attached to the housing means substantially covering the opened top thereof, the first screen means sloping downwardly from the center thereof and having openings therethrough of a size to allow particulate material of a first maximum size to pass therethrough; and a second screen means attached to housing means beneath the first screen means, the second screen means sloping downwardly from the center thereof and having openings therethrough of a size to allow particulate material of a second maximum size to pass therethrough, the second maximum size being smaller than the first maximum size.

DESCRIPTION OF THE PREFERRED EMBODIMENT

Figure 1:
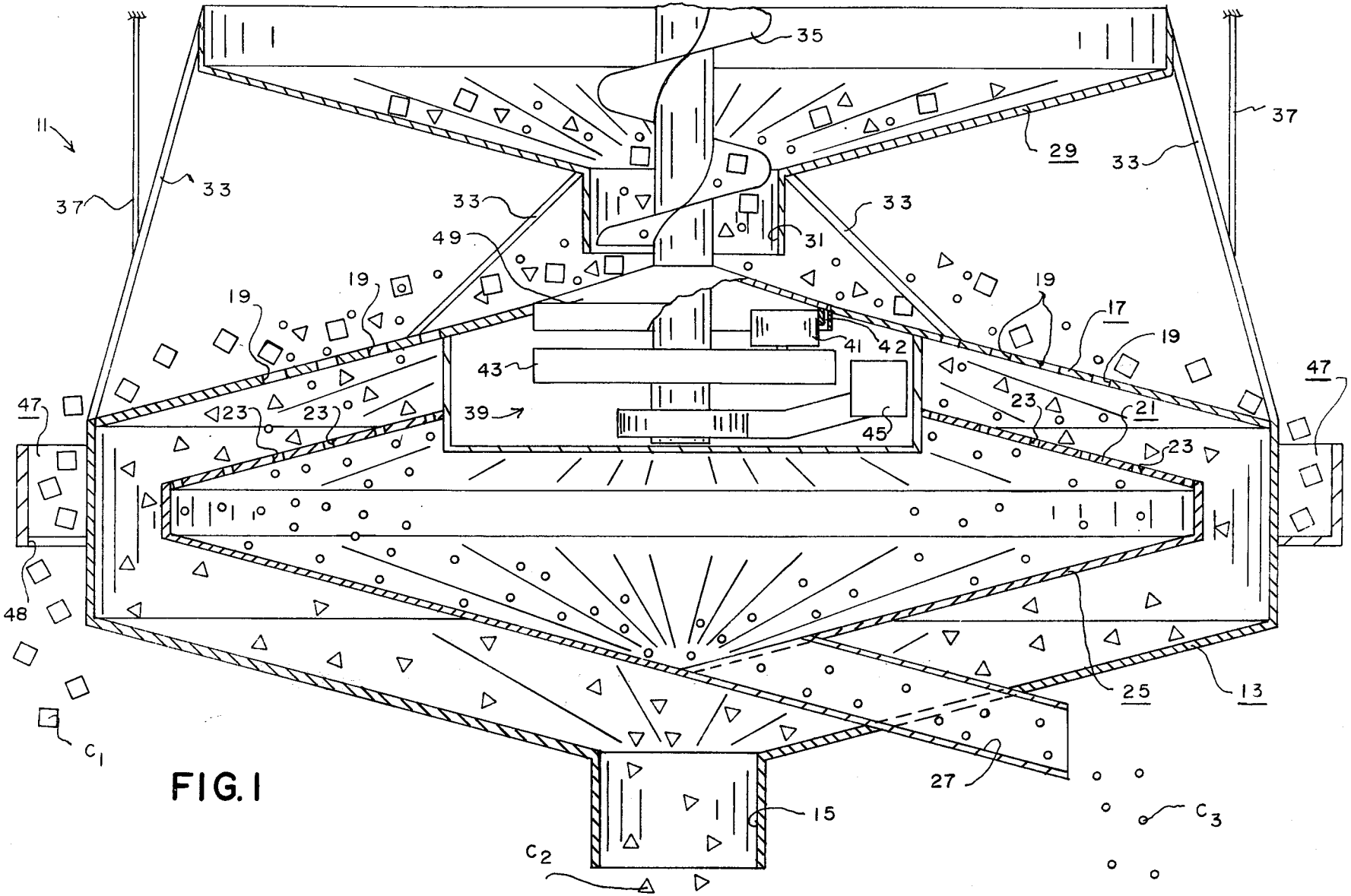
FIG. 1 is a sectional view of a first embodiment of the sorting apparatus of the present invention showing a mix of wood chips being sorted into three groups according to size.
Figure 2:
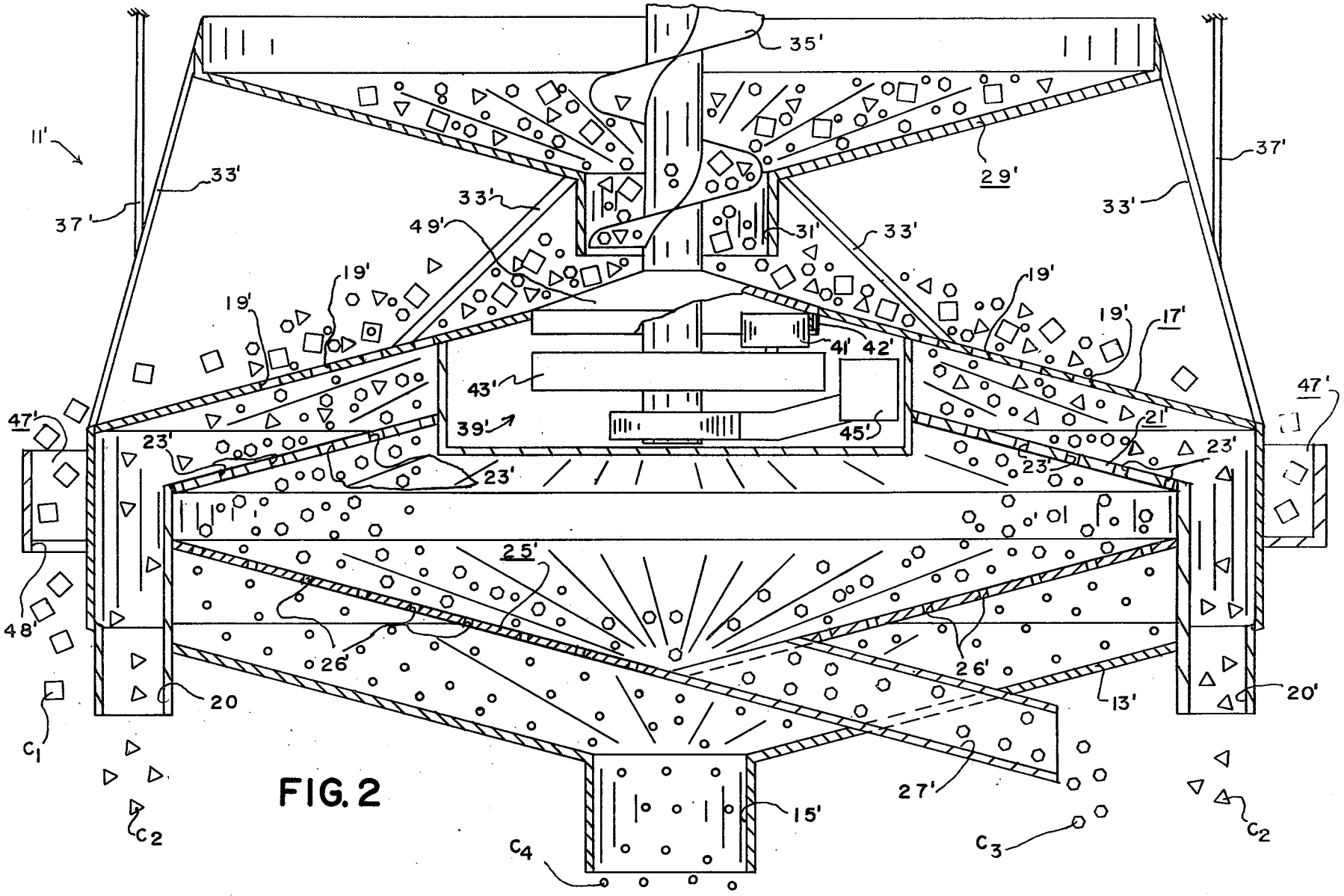
FIG. 2 is a sectional view of a second embodiment of the sorting apparatus of the present invention showing a mix of wood chips being sorted into four groups according to size.

The sorting apparatus of the present invention is for use in sorting a mix of particulate material, such as wood chips, of various sizes into groups based on size. A first embodiment of the present invention is shown in FIG. 1. This embodiment is for sorting wood chips into three groups according to size: a first or large size chip $C_1$; a second or intermediate size chip $C_2$; and a third of small size chip $C_3$. A second embodiment of the present invention is shown in FIG. 2. This embodiment is for sorting wood chips into four groups according to size: a first or largesize chip $C_1$; a second or large intermediate chip $C_2$; a third or small intermediate size chip $C_3$; a fourth or small chip $C_4$.

In the first embodiment of the present invention (FIG. 1), the sorting apparatus is identified by the numeral 11. The sorting apparatus 11 includes a substantially funnel-shaped housing means 13 having a substantially centrally located outlet port 15 in the bottom thereof. A first screen means 17 is attached to the housing means 13 and substantially covers the opened top of the housing means 13. The screen means 17 includes a plurality of apertures 19 therethrough and slopes downwardly in all directions from the center thereof for reasons which will hereinafter become apparent. A second screen means 21 is located within and is attached to the housing means 13 beneath the first screen means 17 and the above the bottom of the housing means 13 as clearly shown in FIG. 1. The second screen means 21 has a plurality of apertures 23 therethrough and slopes downwardly in all directions from the center thereof for reasons which will hereinafter become apparent. The apertures 19 through the first screen means are larger than the apertures 23 through the second screen means 21 for reasons which will hereinafter become apparent. More specifically, the apertures 19 are preferably of a size which allows the second and third size wood chips $C_2$, $C_3$ to pass therethrough while preventing the first size wood chip $C_1$ from passing therethrough and the apertures 23 are of a size to allow the third size wood chip $C_3$ to pass therethrough while preventing the second size wood chips $C_2$ from passing therethrough. The housing means 13 includes an intermediate floor member 25 positioned intermediate the second screen means 21 and the bottom of the housing means 13 as clearly shown in FIG. 1 for catching any wood chips passing through the apertures 23 in the second screen means 21. The intermediate floor member 25 slopes downwardly in all directions from the periphery thereof and includes an outlet port 27 located substantially centrally thereof. The outlet portion 27 extends through the bottom of the housing means 13 as clearly shown in FIG. 1.

The sorting apparatus 11 includes a substantially funnelshaped hopper means 29 for holding a quantity of various size wood chips. The hopper means 29 has a substantially centrally located outlet port 31 in the bottom thereof and is fixedly attached to the housing means 13 in such a manner that the outlet port 31 is positioned substantially centrally over the first screen means 17 as clearly shown in FIG. 1. A plurality of brackets 33 or the like may be used to fixedly and rigidly attached the hopper means 29 to the housing means 13. A screw distribution means 35 is provided in the outlet port 31 of the hopper means 29 to feed wood chips from the hopper means 29 onto the first screen means 17. The screw distribution means 35 will also function to break up large wood chips or the like as the wood chips are fed through the outlet port 31. The sorting apparatus 11 is movably mounted to supporting structure (not shown) by a plurality of cables 37 or the like. The sorting apparatus 11 includes a removable drive means 39 for causing the sorting apparatus 11 to vibrate upon the cables 37. The drive means 39 is preferably attached to the housing means 13 and may consist of any type apparent to those skilled in the art. For example, the drive means 39 may include an electric motor 41 fixedly mounted to other structure of the housing means 13 as by the anchor member 42, a gear reducer unit 43, and a counterweight member 45 for causing the housing means 13 to vibrate when the electric motor 41 is activated in a manner well known to those skilled in the art. The electric motor 41 and gear reducer unit 43 are preferably used to drive the screw distribution means 35 in addition to the counterweight member 45. A peripheral trough means 47 is positioned on the periphery of the top of the housing means 13 for reasons which will hereinafter become apparent. An outlet port 48 is provided in the trough means 47. A deflector means 49 is preferably attached to the first screen means 17 at the center thereof for deflecting the wood chips fed from the hopper means 29. The upper surface of the deflector means 49 slopes downwardly on all sides from the center thereof.

The housing means 13 and screen means 17, 21 are preferably concentric about a central axis such as the axis of the screw distribution means 35. More specifically, the housing means 13 and screen means 17, 21 are preferably in the form of a circle or polygon when viewed from the top or bottom. The screen means 17,21 may consist of a plurality of removable screen sections (not shown) as is well known to those skilled in the art for allowing sections of the screen means 17,21 to be removed from the housing means 13 and cleaned or replaced, etc.

The preferred method of operation of the sorting apparatus 11 is quite simple. A quantity of different size wood chips are placed within the hopper means 29 in a manner well known to those skilled in the art. The drive means 39 is activated to cause the screw distribution means 35 to feed wood chips from the hopper means 29 onto the deflector means 49 and, thus, onto the first screen means 17. The drive means 39 will also cause the housing means 13, and the screen means 17, 21 to vibrate thereby aiding the wood chips in moving down the screen means 17, 21 from the center thereof towards the periphery thereof. The second and third size wood chips $C_2$, $C_3$ will pass through the apertures 19 in the first screen means 17 and onto the second screen means 21. The first size wood chips $C_1$ will pass from the first screen means 17 into the trough means 47 and out the trough 47 through the outlet port 48. A container or the like (not shown) may be placed beneath the outlet port 48 for collecting the wood chips $C_1$. The third size wood chips $C_3$ will pass through the apertures 23 in the second screen means 21 and flow through the outlet port 27. A container or the like (not shown) may be placed beneath the outlet port 27 for collecting the third size wood chips $C_3$. The second size wood chips $C_2$ will pass off the second screen means 21 and flow through the outlet port 15 in the bottom of the housing means 13. A container or the like (not shown) may be placed beneath the outlet port 15 for collecting the second size wood chips $C_2$. In this manner, a mix of different size wood chips is sorted into three different groups according to size.

In the second embodiment of the present invention (FIG. 2), the sorting apparatus is identified by the numeral 11'. The sorting apparatus 11' is substantially identical both in construction and operation to the first embodiment of the sorting apparatus and like parts and elements are identified by the same numeral with a prime affixed thereto to identify the second embodiment. The second embodiment includes one or more auxiliary outlet ports 20' for allowing the wood chips $C_2$ which pass through the first screen means 17' but not the second screen means 21' to exit the housing means 13' therethrough. The sorting apparatus 11' also includes a third screen means 25' in place of the intermediate floor member 25 of the sorting apparatus 11 for allowing the mix of wood chips in the hopper 29' to be sorted into four groups according to size in a manner which will hereinafter become apparent. The second screen means 25' includes a plurality of apertures 26' therethrough of a size smaller than the apertures 23' in the second screen means 21' for allowing the fourth size wood chips $C_4$ to pass therethrough while preventing the third size wood chips $C_3$ from passing therethrough.

The preferred method of operation of the sorting apparatus 11' is substantially identical to the method of operation of the sorting apparatus 11. More specifically, a mix of wood chips is first placed within the hopper means 29' and the drive unit 39' is activated to cause the housing means 13' to vibrate and to cause wood chips to be fed from the hopper means 29' to the first screen means 17'. The second, third and fourth size wood chips $C_2$, $C_3$, $C_4$ pass through the apertures 19' in the first screen means 17 and fall onto the second screen means 21'. The first size wood chips $C_1$ pass into the through means 47' and out the outlet port 48' where a container or the like (not shown) may be provided to collect the first size wood chips $C_1$. The third and fourth size wood chips $C_3$, $C_4$ pass through the apertures 23' in the second screen means 21' and fall onto the third screen means 25'. The second size wood chips $C_2$ pass out the outlet ports 20' where a container or the like (not shown) may be provided to collect the second size wood chips $C_2$. The fourth size wood chips $C_4$ pass through the apertures 26' in the third screen means 25' and fall out the outlet port 15' where a container or the like (not shown) may be provided to collect the fourth size wood chips $C_4$. The third size wood chips $C_3$ pass out the outlet port 27' where a container or the like (not shown) may be provided for collecting the third size wood chips $C_3$. In this manner, the mix of wood chips in the hopper means 29' is sorted into four groups according to size.

Although the invention has been described and illustrated with respect to a preferred embodiment thereof, it is not to be so limited since changes and modifications may be made therein which are within the full intended scope of the invention.

I claim:

1. Sorting apparatus for sorting particulate material into groups according to size, said sorting apparatus comprising:

(a) housing means having an opened top;

(b) hopper means for holding a quantity of particulate material, said hopper means having an outlet port for allowing particulate material to exit therethrough, said hopper means being fixedly attached to said housing means with said outlet port of said hopper means positioned substantially over the center of said opened top of said housing means;

(c) first screen means attached to said housing means substantially covering said opened top thereof, said first screen means sloping downwardly from the center thereof and having openings therethrough of a size to allow particulate material of a first maximum size to pass therethrough;

(d) second screen means attached to said housing means beneath said first screen means, said second screen means sloping downwardly from the center thereof and having openings therethrough of a size to allow particulate material of a second maximum size to pass therethrough, said second maximum size being smaller than said first maximum size;

(e) drive means attached to said housing means for causing said housing means to vibrate;

(f) screw distribution means for feeding particulate material from said hopper means onto said first screen means; and (g) third screen means attached to said housing means beneath said second screen means, said third screen means sloping downwardly towards the center thereof and having openings of a size to allow particulate material of a third maximum size to pass therethrough, said third maximum size being smaller than said second maximum size; said housing means including a first outlet port means communicatingly attached to said second screen means substantially adjacent the periphery thereof for allowing particulate material which passed through said first screen means but not through said second screen means to exit said housing means therethrough; said housing means including a second outlet port means communicatingly attached to said third screen means substantially centrally thereof for allowing particulate material which passed through said second screen means but not through said third screen means to exit said housing means therethrough; said housing means including a bottom which slopes downwardly towards the center thereof; and said housing means including a third outlet port means communicatingly attached to said bottom of said housing means substantially centrally thereof for allowing particulate material which passed through said third screen means to exit said housing means therethrough.

* * * * *